United States Patent [19]

Mutschler

[11] 4,334,622

[45] Jun. 15, 1982

[54] STAND FOR HOLDING AND SEALINGLY RETAINING INDIA INK DRAWING IMPLEMENTS

[76] Inventor: Otto Mutschler, Ludolf-Krehl-Str. 21, D-6900 Heidelberg, Fed. Rep. of Germany

[21] Appl. No.: 84,639

[22] Filed: Oct. 15, 1979

[30] Foreign Application Priority Data

Nov. 17, 1978 [DE] Fed. Rep. of Germany ..... 2849939

[51] Int. Cl.[3] ..... A47F 7/00

[52] U.S. Cl. ..... 211/69.5; 211/69.6

[58] Field of Search ..... 211/69.5, 69.2, 69.1, 211/69.6, 69.9, 13, 60 R, 99, 86; 108/28; 248/201

[56] References Cited

U.S. PATENT DOCUMENTS

| | | | |
|---|---|---|---|
| 1,804,120 | 5/1931 | Sengbusch | 211/69.5 |
| 3,176,662 | 4/1965 | Williams | 211/69.5 |
| 3,207,317 | 9/1965 | Moore et al. | 211/13 |
| 3,273,846 | 9/1966 | DeMarc | 211/69.1 X |
| 3,428,380 | 2/1969 | Danjczek | 211/69.5 X |
| 3,463,323 | 8/1969 | Raepe | 211/69.5 |
| 3,866,992 | 2/1975 | Katz | 211/69.5 |

*Primary Examiner*—Roy D. Frazier
*Assistant Examiner*—Robert W. Gibson, Jr.
*Attorney, Agent, or Firm*—Kurt Kelman

[57] ABSTRACT

A stand for holding and sealingly retaining a plurality of India ink drawing implements includes a like plurality of sleeves for holding the drawing implements and for sealingly retaining the implements to prevent the India ink therein from drying out. There is a tubular packing in each sleeve and the packing has an annular sealing lip in the interior thereof. A packing insert is in the interior of the tubular packing. A tubular clamping element is inserted in each sleeve rearwardly of the packing and has inwardly projecting cams. The packing insert, the sealing lip and the cams are arranged respectively for sealing and seating and drawing point of the inplement, the front end of its grip and an annular bead on the grip rearwardly of the front end when a respective drawing implement is inserted into the clamping element and packing in a respective sleeve.

6 Claims, 6 Drawing Figures

(II-II)

STAND FOR HOLDING AND SEALINGLY RETAINING INDIA INK DRAWING IMPLEMENTS

The present invention relates to a stand for holding and sealingly retaining a plurality of India ink drawing implements which comprise a tubular drawing point, a grip having a front end to which the tubular drawing point is attached and an annular bead on the grip rearwardly of the front end.

In the manner of fountain pens, a cap is usually placed over the drawing point of such implements to prevent the India ink therein from drying out. However, during drawing, it is often necessary alternately to use implements with tubular drawing points of different gauges. To make certain that each implement functions properly, it is required to place the closing cap over the drawing point after each use of the implement. This is quite time-consuming and it has, therefore, been proposed to provide a stand wherein a plurality of such drawing implements may be held for alternate use. However, none of these stands dependably seal the drawing implements held and retained therein so that they are not fully protected against drying out.

U.S. Pat. No. 3,176,662, dated Apr. 6, 1965, discloses an illustrator's pen-holder desk set comprising a plurality of individual tubular wells for holding the pens and sponges at the bottoms of the wells. The sponges are saturated with water to maintain a moist atmosphere in the wells to prevent drying of the ink in the pen points during the time when the pens are supported in the wells. However, if soaking of the sponges with water is neglected or the set is used for a length of time causing the sponges to dry out, the tubular pen points will not be kept wet. Thus, maintenance of the desk stand for effectively preventing the drying of the pen points is cumbersome and is not really dependable.

It is the primary object of this invention to provide a stand for holding a plurality of India ink drawing implements so that they are securely retained therein so as to be sealed off against any possibility of drying out and without the need of cumbersome maintenance, such as filling the holders with water from time to time.

The above and other objects are accomplished according to the invention with a stand which includes a plurality of sleeves for holding a like plurality of the India ink drawing implements and for sealingly retaining the implements to prevent the India ink therein from drying. A tubular packing in each sleeve has an annular sealing lip in the interior thereof and there is a packing insert in the interior of the tubular packing. A tubular clamping element is inserted in each sleeve rearwardly of the tubular packing and has inwardly projecting camming means. The packing insert, the sealing lip and the camming means are arranged respectively for sealing and seating the drawing point, the front end of the grip and the annular bead on the grip when a respective drawing implement is inserted into the clamping element and packing in a respective sleeve.

This structure assures a triple sealing and seating of the drawing implement in the stand.

The above and other objects, advantages and features of the present invention will become more apparent from the following detailed description of a now preferred embodiment thereof, taken in conjunction with the accompanying drawing wherein FIG. 1 is a fragmentary view of the stand, showing one sleeve in axial cross section, with a drawing implements inserted therein, the figure illustrating the arrangement upside down in relation to FIGS. 4 and 5;

Figure 5A:
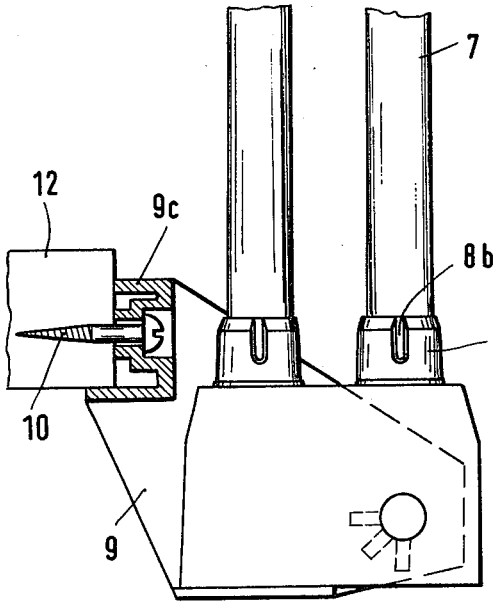
Figure 5B:
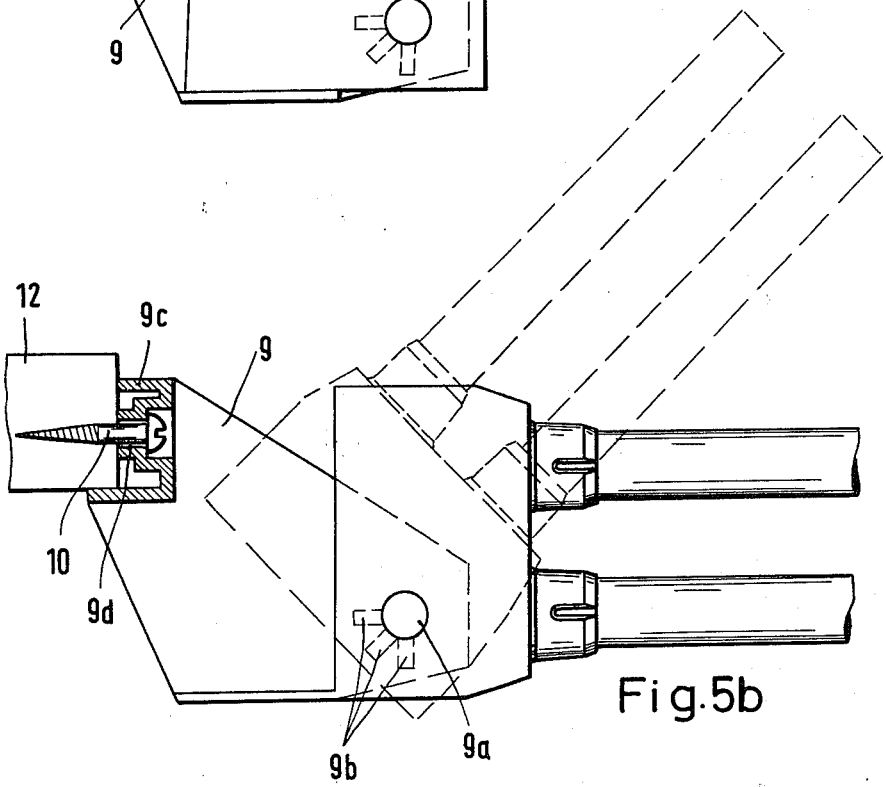

FIG. 5*a* is a side elevational view of the stand held in a mounting frame, in an upright position, a detail being shown in section; and FIG. 5*b* is a like view showing the stand in different pivotal positions.

Figure 1:
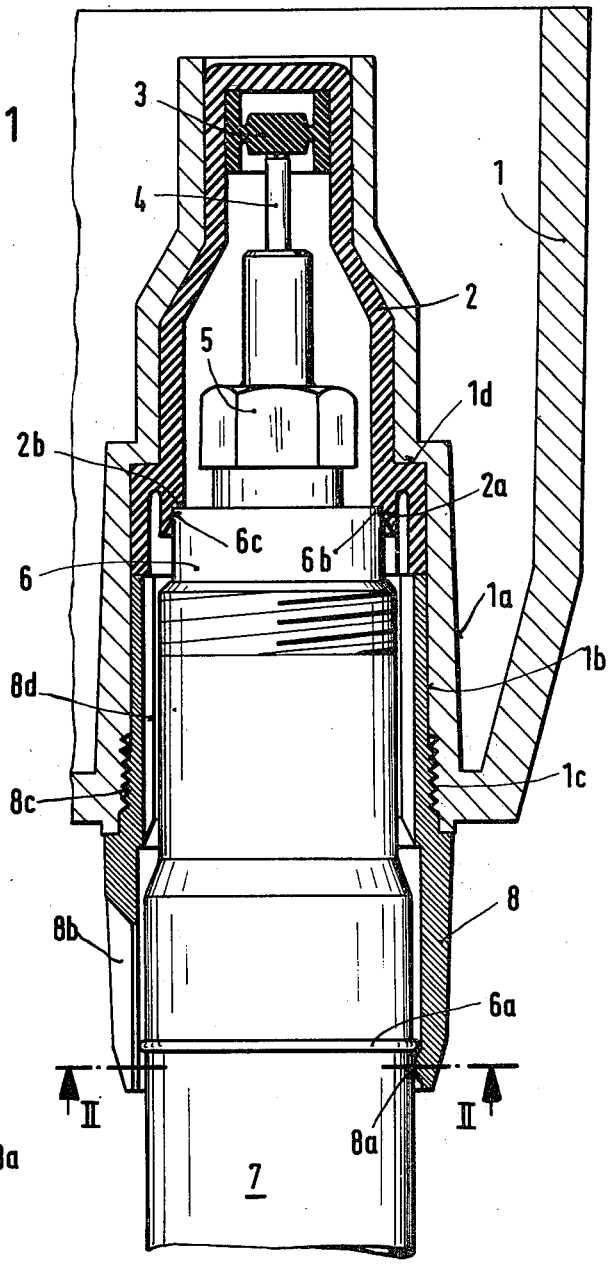
Figure 2:
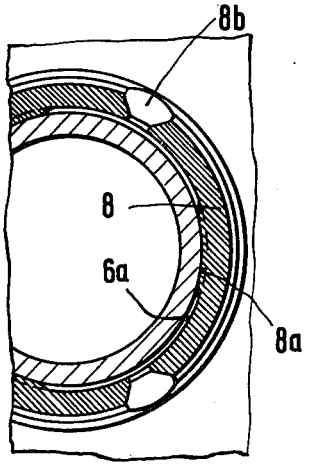
FIG. 2 is a transverse cross section along line II—II of FIG. 1.
Figure 3:
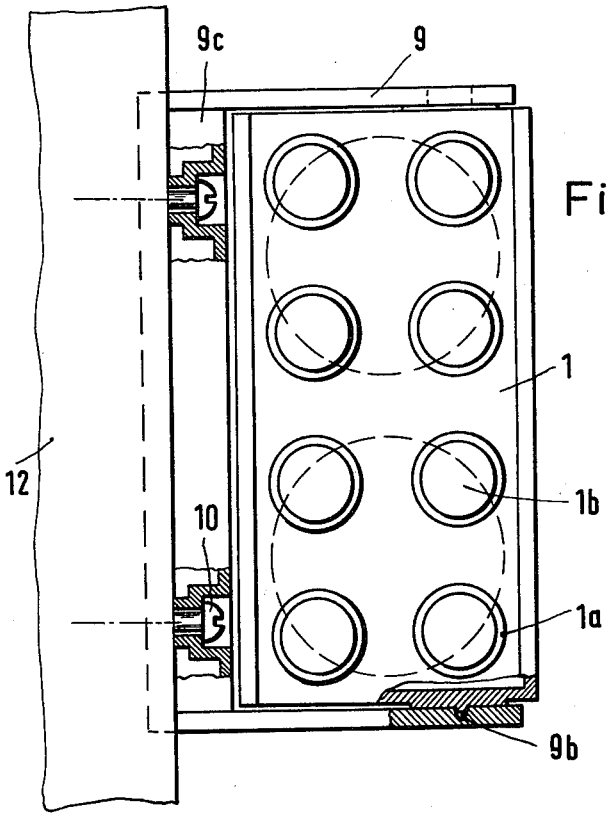
FIG. 3 is a top view of the stand, showing details in section.
Figure 4:
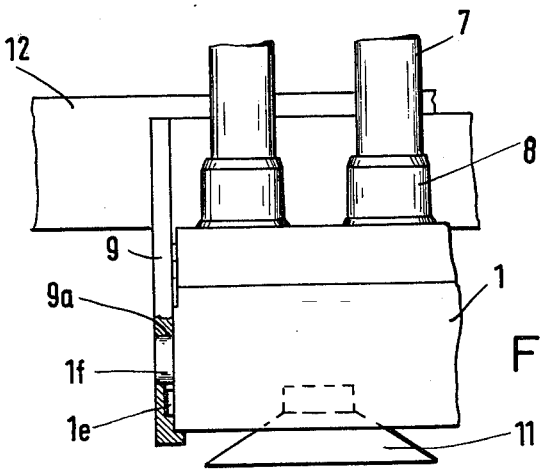
FIG. 4 is a fragmentary front elevational view thereof, showing a detail in section.

Referring now to the drawing and first to FIGS. 1 and 2, there is shown stand 1 which may be made of metal, synthetic resin, wood or any other suitable structural material. The stand includes a plurality of sleeves 1*a*, eight such sleeves being illustrated in FIG. 3 by way of example for holding a like number of India ink drawing implements and for sealingly retaining the implements to prevent the Indian ink therein from drying out.

As shown in FIG. 1, each drawing implement comprises tubular drawing point 4, grip 6 having front end 6*b* to which the tubular drawing point is attached by means of holding member 5 and annular bead 6*a* on grip shaft 7 rearwardly of the front end.

As also shown in FIG. 1, tubular packing 2 is mounted in sleeve 1*a* and the packing has annular sealing lip 2*a* in the interior thereof. Packing insert 3 is located in the interior of tubular packing 2, being seated in its closed end. Tubular clamping element 8 is inserted in each sleeve 1*a* rearwardly of tubular packing 2 and has inwardly projecting camming means 8*a*. As is clear from FIG. 1, packing insert 3, sealing lip 2*a* and camming means 8*a* are arranged respectively for sealing and seating drawing point 4, front end 6*b* of grip 6, 7 and annular bead 6*a* on the grip when a respective drawing implement is inserted into clamping element 8 and packing 2 in a respective sleeve 1*a*. Wall 6*c* of grip front end 6*b* is engaged by sealing lip 2*a*.

In the preferred illustrated embodiment, each sleeve 1*a* has an inner wall 1*b* with annular shoulder or abutment 1*d* and each packing 2 has an outer wall with annular shoulder or abutment 2*b* engaging shoulder 1*d* of the inner wall of sleeve 1*a*. The packing insert is arranged frontwardly of the annular shoulders and tubular clamping element 8 is secured in each sleeve in an axial position to press against packing 2 so that annular shoulder 2*b* of the packing tightly engages annular shoulder 1*d* of the sleeve and prevents longitudinal displacement of packing 2. In the illustrated embodiment, tubular clamping element 8 is threadedly secured in sleeve 1*a*, as shown at 8*c*.

On inserting one of the drawing implements into a respective sleeve 1*a*, effective seating of the implement in the sleeve and triple sealing thereof is achieved when camming means 8*a* in the clamping element engages annular bead 6*a*, i.e. when the camming means snaps over the bead. In this position, the implement can never dry out and is always ready for use upon removal from the sleeve.

To prevent a vacuum effect during the removal of the drawing implement from sleeve 1*a*, tubular clamping element 8 defines a plurality of venting grooves 8*d* extending in an axial direction and spaced about the inner wall of the clamping element at the inner end thereof. Furthermore, the outer end of the clamping element projects from sleeve 1*a* into which it is inserted and defines a plurality of axially extending slots 8*b* circumferentially spaced from each other to impart elasticity to the outer end of the clamping element and thus cause camming means 8 to snap resiliently over annular bead 6*a*.

It is useful for the projecting clamping element part to carry a suitable colored or other marking indicating the gauge of the tubular drawing point of the drawing implement held and sealingly retained therein.

As shown in FIGS. 3, 4, 5*a* and 5*b*, a frame for mounting stand 1 is affixed to drawing board 12. The mounting frame is comprised of two side walls 9, 9 interconnected by ledge 9*c* and the frame ledge is affixed to a suitable portion of drawing board 12 by screws 10 inserted in bores 9*d* in ledge 9*c*. Means is provided for pivoting stand 1 in relation to frame 9, 9*c* between a plurality of pivotal positions and for retaining the stand in each pivotal position. In the illustrated embodiment, the pivoting means comprises pivot pin or stud 1*f* projecting laterally from each side wall of stand 1 into bore 9*a* in adjacent side wall 9 of the mounting frame to provide a pivotal bearing for the stand in the frame. The illustrated retaining means for the stand comprises detent 1*e* projecting laterally from each side wall of stand 1 into a selected one of three grooves 9*b* in adjacent side wall 9 of the mounting frame to retain stand 1 selectively in the three pivotal positions indicated in FIGS. 5*a* and 5*b*, the upright position being shown in FIG. 5*a* while FIG. 5*b* shows the prone position of the stand in full lines and an intermediate pivotal position in broken lines.

Alternately, if it is desired to hold stand 1 securely on a surface, it may be supported thereon by suction cups 11 attached to the bottom of the stand.

I claim:

1. A stand for holding and sealingly retaining a plurality of India ink drawing implements each comprising a tubular drawing point, a grip having a front end to which the tubular drawing point is attached and an annular bead on the grip rearwardly of the front end, the stand including a like plurality of sleeves for holding the drawing implements and for sealingly retaining the implements to prevent India ink therein from drying, a tubular packing in each sleeve, the tubular packing having an annular sealing lip in the interior thereof, a packing insert in the interior of the tubular packing, and a tubular clamping element inserted in each sleeve rearwardly of the tubular packing, the tubular clamping element having inwardly projecting camming means, the packing insert, the sealing lip and the camming means being arranged respectively for sealing and seating the drawing point, the front end of the grip and the annular bead on the grip when a respective one of the drawing implements is inserted into the clamping element and packing in a respective one of the sleeves.

2. A stand for holding and sealing retaining a plurality of India ink drawing implements each comprising a tubular drawing point, a grip having a front end to which the tubular drawing point is attached and an annular bead on the grip rearwardly of the front end, the stand including a like plurality of sleeves for holding the drawing implements and for sealingly retaining the implements to prevent India ink therein from drying each sleeve having an inner wall with an annular shoulder, a tubular packing in each sleeve, the tubular packing having an annular sealing lip in the interior thereof, and an outer wall with an annular shoulder engaging the annular shoulder of the inner wall of the sleeve, a packing insert arranged in the interior of the tubular packing frontwardly of the annular shoulders, and a tubular clamping element secured in each sleeve rearwardly of the tubular packing, in a position to press against the packing so that the annular shoulder of the tubular packing tightly engages the annular shoulder of the sleeve and prevents longitudinal displacement of the packing, the tubular clamping element having inwardly projecting camming means, the packing insert, the sealing lip and the camming means being arranged respectively for sealing and seating the drawing point, the front end of the grip and the annular bead on the grip when a respective one of the drawing implements is inserted into the clamping element and packing in a respective one of the sleeves.

3. The stand of claim 2, wherein the tubular clamping element is threadedly secured in each sleeve.

4. The stand of claim 2, wherein each tubular clamping element projects from the sleeve into which it is inserted and the projecting part of the tubular clamping element carries a marking indicating the gauge of the tubular drawing point of the drawing implement held and sealingly retained therein.

5. The stand of claim 2, further comprises a frame for mounting the stand, means for pivoting the stand in relation to the frame between a plurality of pivotal positions, and means for retaining the stand in each pivotal position.

6. A stand for holding and sealingly retaining a plurality of India ink drawing implements each comprising a tubular drawing point, a grip having a front end to which the tubular drawing point is attached and an annular bead on the grip rearwardly of the front end, the stand including a like plurality of sleeves for holding the drawing implements and for sealingly retaining the implements to prevent India ink therein from drying, a tubular packing in each sleeve, the tubular packing having an annular sealing lip in the interior thereof, a packing insert in the interior of the tubular packing, and a tubular clamping element having inwardly projecting camming means, each tubular clamping element projecting from the sleeve into which it is inserted and the projecting part of the tubular clamping element carrying a marking indicating the gauge of the tubular drawing point of the drawing implement held and sealingly retained therein, the packing insert, the sealing lip and the camming means being arranged respectively for sealing and seating the drawing point, the front end of the grip and the annular bead on the grip when a respective ones of the drawing implements is inserted into the clamping element and packing in a respective one of the sleeves.

* * * * *